US005172857A

United States Patent [19]

Mohring et al.

[11] Patent Number: 5,172,857

[45] Date of Patent: Dec. 22, 1992

[54] COMBUSTION AIR BLOWER FOR AN AUXILIARY HEATER FOR A MOTOR VEHICLE

[75] Inventors: Fritz Mohring, Ostfildern; Martin Stoll, Reutlingen, both of Fed. Rep. of Germany

[73] Assignee: J. Eberspächer, Esslingen, Fed. Rep. of Germany

[21] Appl. No.: 494,968

[22] Filed: Mar. 16, 1990

[30] Foreign Application Priority Data

Mar. 17, 1987 [DE] Fed. Rep. of Germany ... 8903372[U]

[51] Int. Cl.[5] ..... B60H 1/02

[52] U.S. Cl. ..... 237/12.3 C; 126/110 B

[58] Field of Search ..... 237/12.3 A, 12.3 B, 237/12.3 R, 2 A, 12.3 C; 126/110 A, 110 B, 110 C; 415/145

[56] References Cited

U.S. PATENT DOCUMENTS 1,116,753 6/1968 Rotron .
4,439,095 3/1984 Galtz et al. ..... 415/52
4,492,519 1/1985 Owen et al. ..... 415/145
4,749,338 6/1988 Galtz ..... 415/145

FOREIGN PATENT DOCUMENTS 150729 1/1985 European Pat. Off. .
1535677 12/1978 Fed. Rep. of Germany .
WO87/06981 11/1987 PCT Int'l Appl. .
2077354A 5/1981 United Kingdom .
2120546 4/1983 United Kingdom .

*Primary Examiner*—Henry A. Bennet
*Attorney, Agent, or Firm*—McGlew & Tuttle

[57] ABSTRACT

A motor vehicle auxiliary heater annular combustion air blower is disclosed having a housing defining a suction side of the blower and a delivery side of the blower. The housing also defines a mounting bore which extends substantially perpendicular to the bypass channel. A rotary slide valve is provided in the form of a cylindrical pin member which is rotatable within said mounting bore and includes a surface before variable throttling of said bypass channel independence upon the rotational position of said rotary slide valve.

4 Claims, 1 Drawing Sheet

V
V

COMBUSTION AIR BLOWER FOR AN AUXILIARY HEATER FOR A MOTOR VEHICLE

FIELD AND BACKGROUND OF THE INVENTION

The present invention pertains to a combustion air blower, especially an annular channel blower, for an auxiliary heater for a motor vehicle. The invention relates more particularly to a combustion air blower in which the suction side of the blower is connected to the delivery side via a bypass channel, which has an adjustable throttling member, in a communicating manner.

In combustion air blowers of this kind, the bypass channel with the throttling member located therein has the task of setting the air throughput of the blower within certain limits without causing any appreciable change in the power consumption of the blower motor.

In a prior-art combustion air blower (West German Patent Specification No. 32,09,904), the throttling member is designed as an adjusting screw. However, this requires the preparation of a female thread running perpendicularly to the longitudinal axis of the bypass channel. Because the housing of the combustion air blower usually consists of a plurality of injection molded parts, and particularly the part containing the bypass channel is an injection molded part, a separate operation is required to prepare the female thread for the adjusting screw after the molding of the part.

SUMMARY AND OBJECT OF THE INVENTION

It is an object of the invention to further improve a combustion air blower of the type mentioned in the introduction so that the arrangement and the setting of the throttling member on the bypass channel will be simplified compared with the above-described known arrangement.

This task is accomplished by designing the throttling member as a rotary slide valve and mounting it in a mounting bore of the housing. Because the throttling member is a rotary slide valve, the mounting bore can be a smooth bore, which is prepared at the time of the injection molding of the part and does not require any finishing.

If, according to the present invention, the rotary slide valve is a pin provided with a longitudinal or cross slot or the like on the outside and has a reduced, approximately semicircular cross section, especially a semicircular tubular cross section as a throttling member on the inside in the area of said bypass channel, it is possible to achieve a practically linear change in the cross section of the bypass channel by rotating the rotary slide valve, as a function of the angle of rotation.

Once the desired setting has been reached, the rotary slide valve is secured according to the present invention with a screw lacquer (adhesive) on the housing. A change in the setting of the rotary slide valve from a position once set is thus no longer possible even under high mechanical stress.

The various features of novelty which characterize the invention are pointed out with particularity in the claims annexed to and forming a part of this disclosure. For a better understanding of the invention, its operating advantages and specific objects obtained by its uses, reference is made to the accompanying drawings and descriptive matter in which a preferred embodiment of the invention is illustrated.

DETAILED DESCRIPTION OF THE PREFERRED EMBODIMENT

Figures 1, 2, 3, 4, 5, 6:
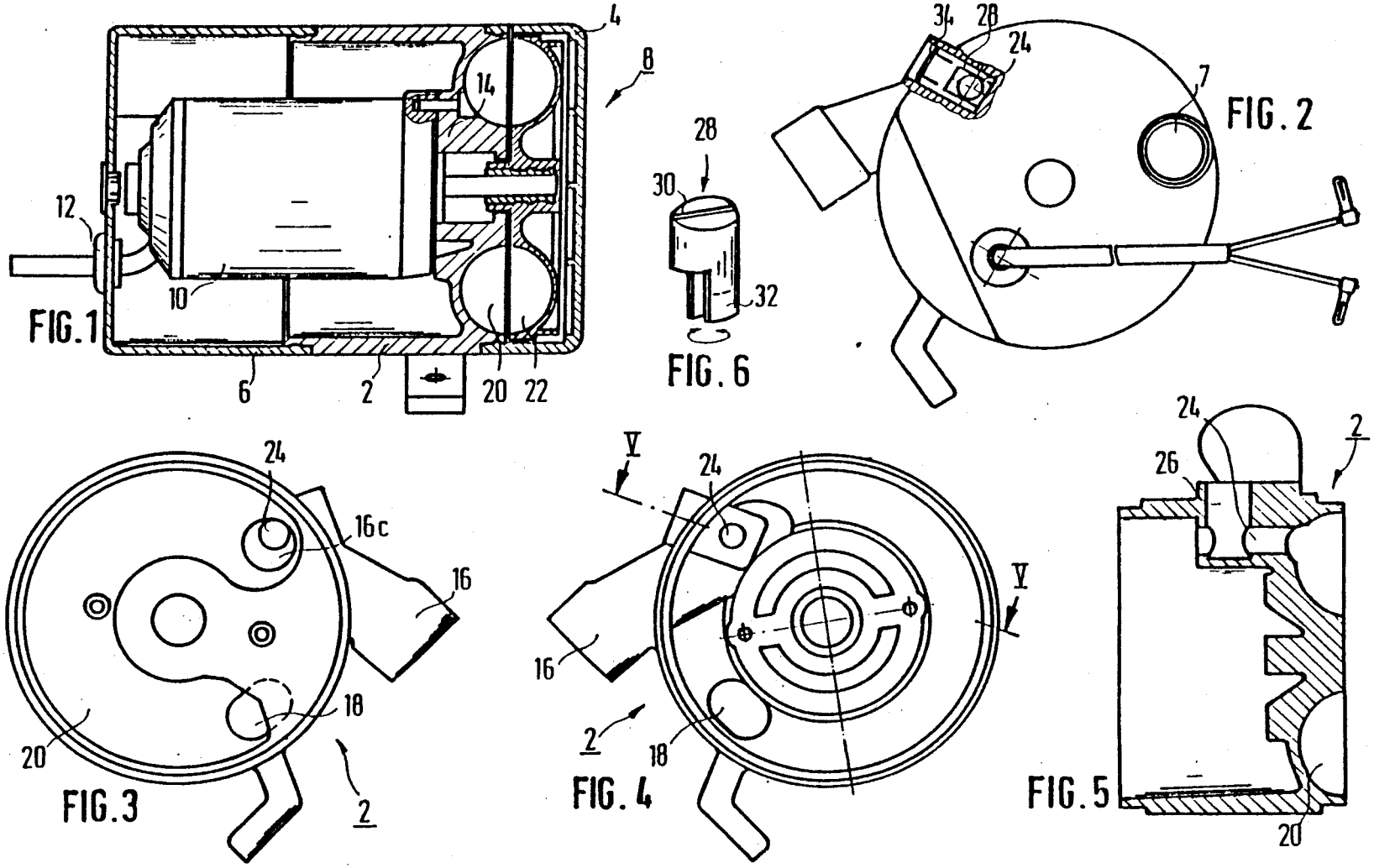
FIG. 1 is a longitudinal sectional view through a combustion air blower designed as an annular channel blower.
FIG. 2 is a view of the annular channel blower from the left side of FIG. 1.
FIG. 3 is a view of a support part of the combustion air blower shown in FIG. 1 from the left according to FIG. 1.
FIG. 4 is a view of the support part according to FIG. 3 from the other side.
FIG. 5 is a sectional view taken along line V—V in FIG. 4.
FIG. 6 is a perspective view of a rotary slide valve.

Referring to the drawings and to FIG. 1 in particular, a combustion air blower according to the invention comprises an annular channel blower with a middle support part 2, which is joined by a front housing cover 4 on the right-hand side and a rear housing cover 6 on the left-hand side, and a motor 10, which is supplied with electricity via an electrical supply line passing through a housing cover 6.

The middle support part 2 of the combustion air blower forms part of the outer wall of the housing and, adjacent the middle zone 14, also an annular channel part, in which an annular channel 20 extending through ca. 300° is provided (cf. FIG. 3). Said fixed annular channel 20 faces an annular channel of a rotating annular channel part 22, which is fixed on a drive shaft of said motor 10. An air inlet opening 7 is located in the said rear housing cover 6 (cf. FIG. 2).

As is apparent from FIG. 3, an air inlet 18 and an inner air outlet channel 16*c*, which is extended from a channel connection 16 outside the housing 2, open into the annular channel 20.

When the annular channel part 22 rotates, the volume of air in the space defined by the two adjacent annular channels is acted on during each revolution, so that air is blown off from the inner outlet channel 16*c*.

As is shown in FIG. 5, the pressure side of the blower, which is located on the right-hand side, i.e., the annular channel 20, is connected via a bypass channel 24 to the suction side of the blower, which is located on the left-hand side in FIG. 5. A smooth mounting bore 26 is disposed running from the outside of said support part 2 perpendicularly to said bypass channel 24. The bypass channel 24 is designed as a bore parallel to the longitudinal axis of the blower.

A rotary slide valve 28, which is shown in the mounted state in FIG. 2, is located as a throttling member in said mounting bore 26.

FIG. 6 shows the rotary slide valve in detail. It is a tubular, pin-shaped part with a slot 30, into which a screwdriver can be inserted in order to rotate the rotary slide valve 28. A throttling part 32, which has an approximately semicircular tubular cross section, is located on the rotary slide valve in the inner zone, i.e., oriented toward the longitudinal axis of the blower. The free flow cross section of the bypass channel 24 can be varied by rotating the rotary slide valve 28 in one direction or the other. After the optimal setting has been reached, the rotary slide valve 28 is secured with screw lacquer 34 (See FIG. 2), so that it remains in its position even during vibrations.

To adjust the air throughput in the zone of said throttle part even more finely and accurately, and to also expand the range of setting, the throttling part can be provided with one or two oblique sections, as is indicated by a broken line in FIG. 6. The oblique section or oblique sections begin at the end face of the throttling part in the zone of the axis of symmetry and extend obliquely in the outward direction at an angle of substantially 45°. The throughput or the intensity of throttling can be adjusted extremely finely and accurately due to such a design of the throttling part. In addition, the range of setting is expanded as well.

While a specific embodiment of the invention has been shown and described in detail to illustrate the application of the principles of the invention, it will be understood that the invention may be embodied otherwise without departing from such principles.

What is claimed is:

1. A motor vehicle auxiliary heater annular channel combustion air blower, comprising a blower suction side and a blower delivery side defined by a housing a bypass channel extending between said suction and said delivery side of said blower; a mounting bore defined by said housing extending through said bypass channel; and, a rotary slide valve, said rotary slide valve being positioned within said mounting bore and rotatable to throttle said bypass channel said rotary slide valve being formed as a pin member accessible from outside of said housing, said slide valve including one of a longitudinal slot or a cross slot having a reduced, substantially circular cross section disposed on the inside of said housing in the area of said bypass channel.

2. A combustion air blower according to claim 1, wherein said rotary slide valve is formed as a pin member accessible from outside of said housing, said slide valve including one of a longitudinal slot or a cross slot having a reduced, substantially circular cross section disposed on the inside of said housing in the area of said bypass channel.

3. A motor vehicle auxiliary heater annual channel combustion air blower, comprising a blower suction side and a blower delivery side defined by a housing a bypass channel extending between said suction and said delivery side of said blower; a mounting bore defined by said housing extending through said bypass channel; and, a rotary slide valve, said rotary slide valve being positioned within said mounting bore and rotatable to throttle said bypass channel, said rotary slide valve being secured to said housing of said combustion air blower with screw lacquer or adhesive.

4. A motor vehicle auxiliary heater annual channel combustion air blower, comprising a blower suction side and a blower delivery side defined by a housing a bypass channel extending between said suction and said delivery side of said blower; a mounting bore defined by said housing extending through said bypass channel; and, a rotary slide valve, said rotary slide valve being positioned within said mounting bore and rotatable to throttle said bypass channel, said rotary slide valve being formed of a pin structure accessible from outside of said housing, said slide valve including a slot having a reduced substantially circular cross section, said slot being positioned on the inside of said housing in the area of said bypass channel, said rotary slide valve including legs defined by said substantially circular cross section to provide a throttling part with an oblique section at an angle of substantially 45 degrees, extending obliquely from a plane of symmetry toward an outer end of said rotary slide valve.

* * * * *